United States Patent [19]

Clay

[11] 4,248,112

[45] Feb. 3, 1981

[54] LABEL MACHINE

[75] Inventor: Bobby J. Clay, Cincinnati, Ohio

[73] Assignee: Natmar, Inc., Cincinnati, Ohio

[21] Appl. No.: 920,178

[22] Filed: Jun. 29, 1978

[51] Int. Cl.[3] ..... B26D 5/24

[52] U.S. Cl. ..... 83/241; 83/231; 83/261; 83/263; 83/202

[58] Field of Search ..... 83/202, 231, 241, 244, 83/262, 263, 273, 289, 261, 265

[56] References Cited

U.S. PATENT DOCUMENTS

| | | | |
|---|---|---|---|
| 2,075,037 | 3/1937 | Hunter | 83/202 X |
| 2,133,868 | 10/1938 | Morton | 83/202 X |
| 2,684,655 | 7/1954 | Kuhnle | 83/231 X |

*Primary Examiner*—Donald R. Schran

*Attorney, Agent, or Firm*—Wood, Herron & Evans

[57] ABSTRACT

A label machine for forming individual labels from an endless tape strip. The machine includes a novel label removal device which uses compressed air to insure removal of each label to a collection station after it is cut from the endless strip, thereby preventing hang-up of labels at the machine's cutter assembly. The machine also includes a novel tape feed mechanism that provides accurate label length control, thereby preventing waste of tape. These mechanisms are preferably used in combination with a printer head, the novel tape feed and label removal mechanisms cooperating to prevent printing errors between leading and trailing labels cut from the endless tape strip.

7 Claims, 8 Drawing Figures

LABEL MACHINE

This invention relates to label machines.

In recent years, it has become common practice to bond heat sensitive labels to garments. This use of heat sensitive labels is quite prevalent in the uniform rental industry. In this use situation, a number of labels are cut from a reel of heat sensitive tape, each individual label being printed with, e.g., the customer code number and rental company route number, to insure return of the rental garments to the right customer after cleaning or washing by the uniform rental company. These individual labels have been heretofore produced by a label machine that provides the dual function of cutting the labels to length from an endless tape strip, and printing the code on the labels.

Label machines which are known to the prior art, and which operate with a reel of heat sensitive tape to cut and print labels, are susceptible to two problems in commerical practice. First, once the label has been printed and cut from the endless tape strip, removal of that label from the machine's printing platen and cutter assembly is generally accomplished by mechanical means. One mechanical structure known to the prior art for removing such a cut and printed label is disclosed in U.S. Pat. No. 2,515,354. The structure shown in that patent uses a flipper bar to mechanically flip the label off the printing platen. Another mechanical structure known to the prior art for removing a cut off label from the printing platen is in the nature of a small conveyor belt type assembly which, in effect, conveys the newly formed label away from the machine's printer head and cutter assembly location. Both these structures, which have seen commerical use in the past, provide periodic maintenance problems to the user. Further, these structures are not always totally effective in removing a preceding label prior to a trailing label being thrust onto the printing platen. If this undesirable result occurs, the printer head may print partially on the trailing label and partially on the leading label. The second problem associated with these prior art label machines is the problem of controlling the length of the labels produced. This problem is inherent to the machines's tape feed mechanisms which function to extend or withdraw from the endless tape reel a new label length to be cut off by the cutter assembly, It has been found that the prior art tape feed mechanisms are not as effective as is desired to control the label length. Some labels may be too short with the attendant result that not all the printed indicia is received from the machine's printer head on the label, and some labels may be too long with the attendant waste of tape. One prior art tape feeder assembly is illustrated in the aforementioned U.S. Pat. No. 2,515,354.

It is the primary objective of this invention to provide an efficient and reliable label removal mechanism and method for removing a cut and printed label into a collector from the cutter assembly and printer head area of a label machine. In accord with this objective, this invention comtemplates a label ejector nozzle positioned in operational relation with the cutter assembly, the label ejector nozzle being connected with an air source. Air discharged from the ejector nozzle is operable to blow each label away from the mechanism to a collection station after the label has been cut from the endless strip. In preferred form, the nozzle is connected with pneumatic motor means adapted to actuate a component of the label machine, the exhaust air from the pneumatic motor functioning as the air source. This novel structure and method insures the label will be removed from the cutter assembly and printer head quickly and efficiently time after time into the collection station. In turn, the reliable removal of the label time after time insures that a trailing label will not pass partially under or over a leading label and, therefore, insures there will not be any partial printing by the printer head on the trailing or leading label.

Another objective of this invention is to provide an improved tape feed mechanism which is effective to insure a predetermined label length being accurately reproduced time after time, i.e., which insures the endless tape strip will be extended from the tape reel beyond the cutter assembly an identical distance time after time. In this connection, this invention contemplates a brake shoe movable into and out of braking relation with the tape feed's drive roll. The brake shoe functions to brake the drive roll to a complete stop as soon as the drive roll has entended the endless tape strip the predetermined length, the label length thereby being established and controlled by stopping rotation of the drive roll through use of the brake shoe. In preferred form, the brake shoe is fixed to the end of a reciprocable rack, the rack engaging a pinion fixed to the drive roll's shaft, and the brake shoe cooperates with a brake drum fixed to the drive roll's shaft. This novel structure insures accurate label length time after time by preventing overrun of the tape feed mechanism at relatively rapid label output rates, thereby preventing waste of the tape supply.

A further objective of this invention has been to provide an improved tape alignment mechanism operable to align, and to maintain alignment thereof, the center plane of the tape reel and the center line of the tape strip with the desired planar travel path of the endless strip through the label machine. This alignment mechanism includes novel spool adjustment structure operable to adjust the tape reel laterally relative to the desired planar travel path of the tape strip and novel tape strip adjustment structure operable to adjust the tape strip laterally relative to that desired planar travel path. This alignment mechanism permits a label machine to be used with varying width tapes without changing alignment of the tape feed mechanism of the printer head.

Other objectives and advantages of this invention will be more apparent from the following detailed description taken in conjunction with the drawings in which:

FIG. 3 is a cross sectional view taken along lines 3—3 of FIG. 2;

Figure 1:
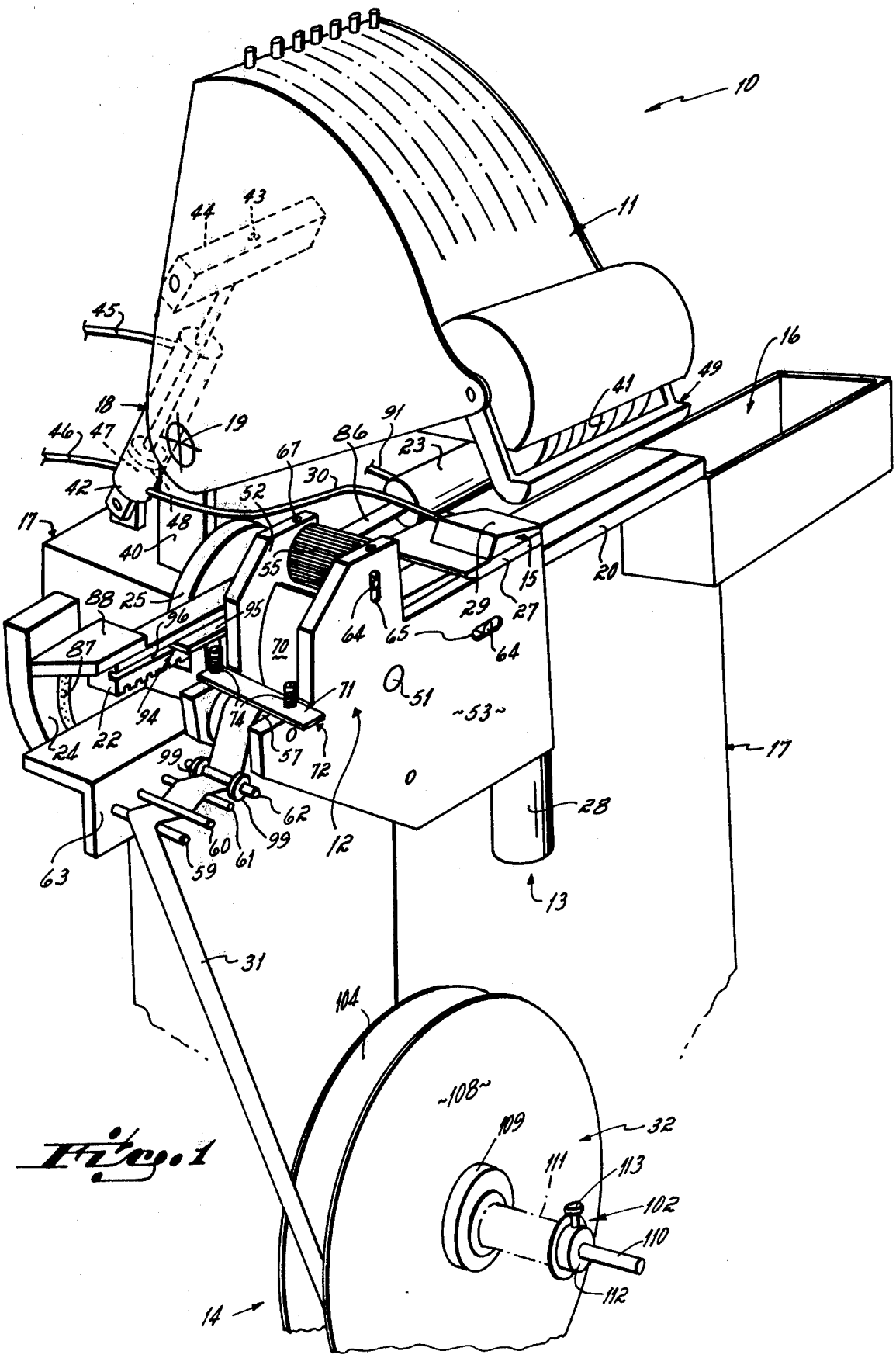
FIG. 1 is a diagrammatic perspective view illustrating a label machine in accord with the principles of this invention.

A label machine 10 in accord with the principles of this invention is illustrated generally in FIG. 1. The label machine 10 basically includes a printer head 11, a tape feed mechanism 12, a cutter assembly 13, a tape alignment mechanism 14, a label ejector nozzle 15, and a collection station 16, all mounted on frame 17. The printer head 11, as operated by pneumatic motor 18, pivots on axis 19 into and out of printing relation with platen 20. The tape feed mechanism 12 includes a drive roll 21 rotated by linearally reciprocable rack 22, the rack being powered by pneumatic motor 23. The rack 22 carries a brake shoe 24 at its outer end which reciprocates into and out of braking relation with brake drum 25, the brake drum 25 being fixed to rotate with the drive roll 21. The cutter assembly 13 includes a cut off blade 26 that cooperates with a cutter anvil 27, see FIG. 3, the cutter assembly being powered by pneumatic motor 28. The label ejector nozzle 15 is defined in nozzle head 29, and is connected by line 30 with the printer head's pneumatic motor 18.

Figure 2:
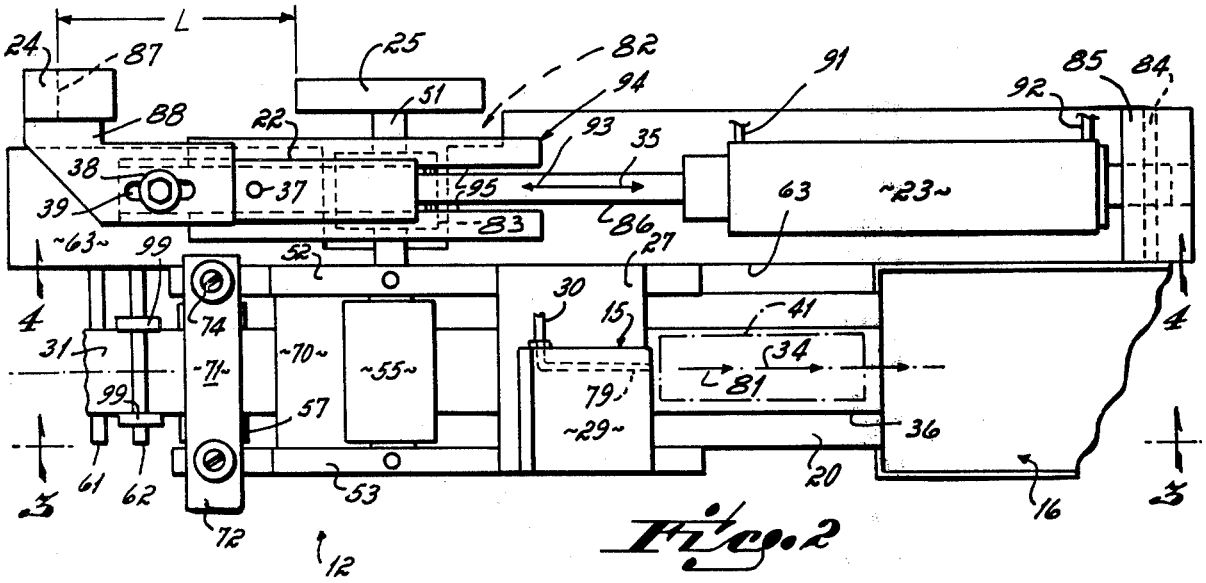
FIG. 2 is a top view of the label machine's tape feed mechanism in accord with the principles of this invention.

In use, and generally speaking, an endless tape strip 31 is received in reel 32 form on supply spool 33, the strip being wound through the tape feed mechansim in a desired common planar travel path 34 for the endless strip through the machine, see FIGS. 1–3. In response to a work stroke 35 of rack 22, drive roll 21 is rotated clockwise as shown in the figures to extend a leading section 36 of the endless strip 31 onto the platen 20, the brake shoe 24 being movable into braking relation with the brake drum 25 at the end of the rack's work stroke 35 so as to instantly stop the drive roll 21, thereby establishing and controlling the predetermined length of section 36 and, hence, for the label 36*a*. Subsequently, the printer head 11 is reciprocated into printing contact with the tape section 36 on the platen 20, the printer head remaining in printing contact with the tape section on the platen to hold it down while the cutter blade 26 of the cutter assembly is operated by the pneumatic motor 28 to cut the predetermined label length 36 from the endless strip 31. Thereafter, the printer head 11 is reciprocated back into the home position shown in FIG. 1, exhaust air from the printer head's pneumatic motor 18 during its return stroke being exhausted through air line 30 and, hence, through the label ejector nozzle 15, for blowing the severed label 36*a* away from the printer head 11 and cutter assembly 13 into the collection box 16.

The printer head 11, as shown in FIG. 1, is pivotally mounted on support posts 40 fixed to the machine frame 17. The printer head 11 is pivoted on axis 19 between its home position shown in FIG. 1, and a print position (not shown, but where type wheels 41 are impressed against tape section 36 on the printing platen 20) by the double acting type pneumatic cylinder 18. The pneumatic cylinder 18 is pivotally fixed at cylinder end 42 to the machine frame 17, and is fixed at piston rod end 43 to cross bar 44 in the printer head 11. The pneumatic cylinder 18 is connected with a compressed air source by high pressure lines 45, 46 and valving, not shown, at each end thereof. The exhaust air side 47 of the cylinder 18, when the piston 48 moves from air line 45 end to air line 46 end, i.e., when the printer head 11 is returned from printing position to home position, in response to compressed air through line 45, is connected by exhaust air line 30 to the label ejector nozzle 15. the printer head 11 itself, and the inking assembly 49 that serves the printer head, is more particularly disclosed and described in U.S. Pat. No. 2,672,811.

Figure 5:
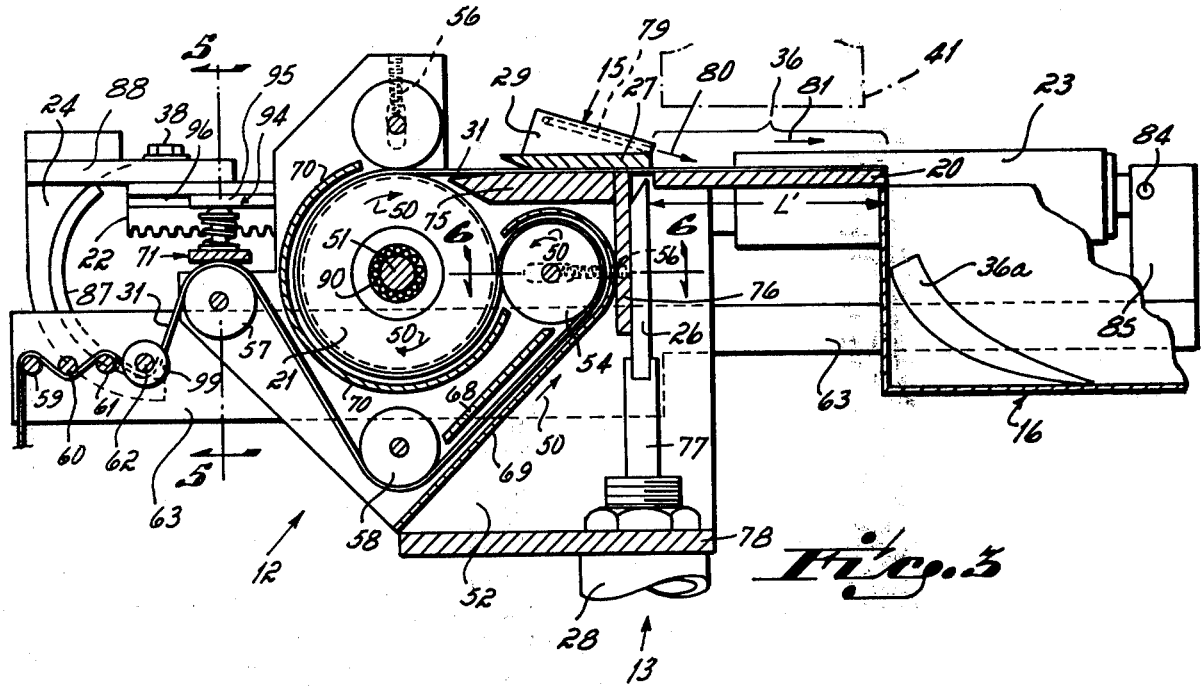
FIG. 5 is a cross scetional view taken along lines 5—5 of FIG. 3.

The tape feed mechanism 12 is particularly illustrated in FIGS. 1–7. As shown in FIGS. 2 and 3, the tape feed mechanism 12 includes a drive roll 21 having its axle 51 journalled between fixed or immobile side plates 52, 53. The drive roll 21 is associated with tensioning apparatus that includes idler rolls 54, 55 which are spring 56 loaded against the drive roll's outer surface, idler rolls 57, 58 which are spaced from the drive roll, and stationary tension pins 59–62. The idler rolls 54, 55, 57 and 58 are journalled between the side plates 52, 53, but the tension pins 59–62 are fixed to angle bracked 63 that is mounted to side plate 52. The spring 56 loaded idler rolls 54 and 55 have shafts ends 64 journalled in slots 65 defined in the side plates 52, 53, the springs 56 being set in side plate bores 66, as restrained by set screws 57, for holding the spring loaded idler rolls in spring loaded contact with the drive roll's surface, see FIG. 6. The compression of springs 56 is adjustable through use of set screws 67. The idler rolls 54, 55, 57 and 58 are all preferably knurled on the exterior surface, but the stationary pins 59–62 are provided with a smooth surface. A presser foot 71 cooperates with the first or downstream idler roll 57 to aid in preventing backlash, and to iron out any wrinkles in the tape strip 31 as it enters the general area of the drive roll 21, see FIGS. 3 and 5. This presser foot 71, as shown in FIGS. 3 and 5, includes plate 72 which extends across the idler roll 57 and is held in spring 73 loaded relation therewith by bolts 74 received in the opposed guide plates 52, 53, see FIG. 5. Also, note the guide elements 68–70 which aid in preventing backlash of the endless tape strip 31 as it proceeds through the tape feed mechansim 12, the guide elements being trapped between the inside faces of the opposed guide plates 52, 53 in grooves, not shown. As shown particularly in FIG. 3, the endless tape strip 31 proceeds in direction 50 from the supply spool 14 through the series of four tension pins 59–62, between the presser foot 71 and idler roll 57, under the idler rolls 58, then up and around the spring loaded idler roll 54, and then around drive roll 21 and under idler 55 to provide a substantially 270° wrap for the endless tape strip 31 about the drive roll 21.

The endless tape strip 31 is ejected outwardly from the tape feed mechansim 12 in generally horizontal fashion onto support plate 75 and then onto the printing platen 20 until a predetermined length section 36 has been ejected. The endless tape strip 31 passes beneath cutter anvil 27 that is mounted on the guide plates 52, 53 across the width of the strip as shown in FIGS. 2 and 3, cutter knife blade 26 being vertically reciprocable into and out of cutting relation with the cutter anvil as shown in FIG. 3. The knife blade 26 is guided in its vertical motion by guide plate 76 fixed between the side plates 52, 53. The knife blade 26 is powered by an air return pneumatic cylinder 28, and is connected to that cylinder's piston rod 77 at one end, cylinder being fixed to frame 78 that also extends between the side plates 52, 53. The label ejector nozzle 15 is fixed in place on top of the cutter anvil 27, the nozzle including a longitudinally oriented bore 79 therein adapted to direct an air discharge (indicated by phantom arrow 80) in a plane generally parallel to the travel path 81 of the tape strip 31 through the machine, and directed away from the cutter assembly 13 and tape feed mechanism 12 toward collection station 16. Note that the machine's collection station 16 is in the nature of a box or tray, and is fixed to the machine's frame 17 downstream of the printing platen 20 so that the label section 36 sliced from the endless tape strip 31 by the blade 26 can be blown off the platen into the tray.

Figure 4:
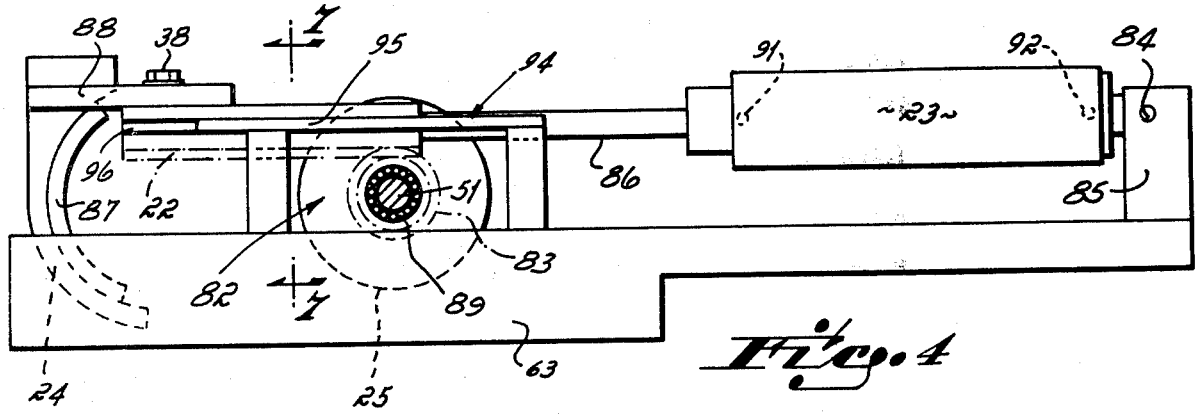
FIG. 4 is a cross sectional view taken along lines 4—4 of FIG. 2.
Figure 5:
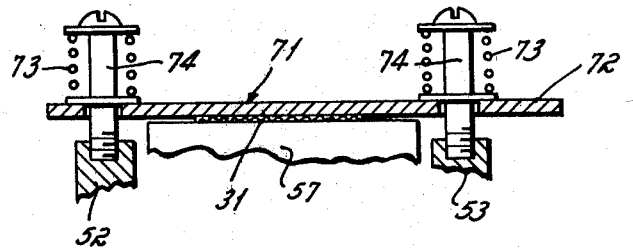
Figure 6:
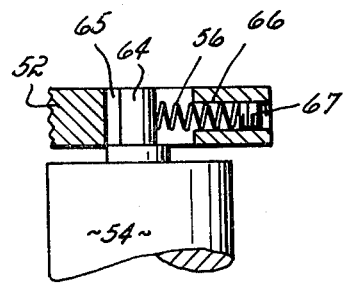
FIG. 6 is a cross sectional view taken along lines 6—6 of FIG. 3.
Figure 7:
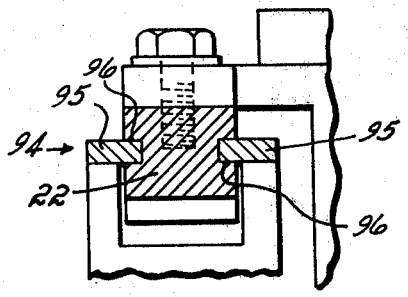
FIG. 7 is a cross sectional view taken along lines 7—7 of FIG. 4.

The tape feed mechanism also includes drive means 82 for rotating the drive wheel 21, see FIGS. 2, 4 and 7. The drive means 82 is comprised of a pinion 83 mounted on drive wheel shaft 51 that cooperates with linear rack 22 extended and retracted by a pneumatic cylinder 23. The pneumatic cylinder's housing is pinned at 84 to post 85 on the bracket 63, and free end of the piston rod 86 is connected to the rack 22.

The pneumatic cylinder 23 is connected with a compressed air source at both ends by air lines 91, 92 to provide positive force on the rack's work strokes 35 and return 93 strokes. The pinion gear 83 is journalled on the drive shaft 51 at one end by a one-way clutch bearing 89, and the other end of the drive shaft 51 is journalled in the sideplate 53 also by a one-way clutch bearing 90, the one-way clutch bearings 89, 90 cooperating to allow rotation of the drive roll 21 clockwise as illustrated in the Figures, but preventing rotation of the drive roll counter-clockwise. Any one-way clutch bearing structure may be used. The rack 22 is guided in its linear stroke 35, 93, and is maintained in meshed relation with the pinion gear 83, by track 94 fixed to the angle bracket 63, which track carries slide rails 95 received in grooves 96 on opposite sides of the rack, see FIG. 7.

The rack 22, at the free end thereof, mounts the brake shoe 24 (which includes a brake lining 87), the brake shoe being carried on plate 88 fixed to the rack by bolt 38. The brake shoe 24 itself cooperates with brake drum 25 which is fixed on the drive wheel shaft 51. Note, as shown in FIG. 2, the brake shoe's plate 88 is provided with a slot 39 that permits the plate and, hence, the brake shoe 24, to move longitudinally of the rack 22 when bolt 38 is loosened. The slot 39 and bolt 38 constitute brake shoe locator structure for varying the reciprocable stroke length L of the brake shoe 24 relative to the drive roll 21 and, more specifically, relative to the brake drum 25. It is this reciprocable stroke length L of the brake shoe 24 relative to the brake drum 25 that determines the length L′ of the endless label strip section 36 which is extended beyond the cutter blade 26 in response to rotation of the drive roll 21. Hence, and by moving the brake shoe 24 longitudinally relative to the rack 22 by use of the bolt 38 and slot 39 structure, an increase or decrease in the length L′ of the extended endless strip can be achieved since this length L′ responds directly to the increase or decrease, respectively, of the brake shoe stroke length L relative to the drive roll. To further accommodate the adjustment of length L′, a second hole 37 may be provided to receive bolt 38. Variable lengths may then be made as discussed above. Hence, the work stroke 35 of the rack 22 causes the drive wheel 21 to rotate in a clockwise direction until brake shoe 24 contacts brake drum 25, thereby establishing and controlling the predetermined length L′ of the label strip's section 36 extended beyond the knife blade 26. The return stroke 93 of the rack 22 simply repositions the brake shoe 24 at a home position preparatory to the next cycle without rotating the drive wheel 21 counter-clockwise because of the one-way clutch bearings 89, 90.

The tape alignment mechanism 14 is operable to align, and to maintain alignment of, the center plane 97 of the tape reel 32 and the center line 98 of the tape strip 31, with the desired planar travel path 34 of the endless tape strip through the machine 10 regardless of the width of the tape being processed by the label machine. The alignment mechanism 14 includes a tape strip adjustment structure illustrated particularly in FIGS. 2 and 3. As shown in those figures, two alignment collars 99 are received in sliding relation on a tension pin 62, rthe alignment collars being retained in a desired position on that pin by set screws (not shown). When the tape width increases or decreases (i.e., when reel 32 is changed), or if the tape is not being retained in desired alignment relative to center plane 34 of the tape feed mechanism 12 and printer head 11, the alignment collars 99 need merely be repositioned as required on the tension pin.

Figure 8:
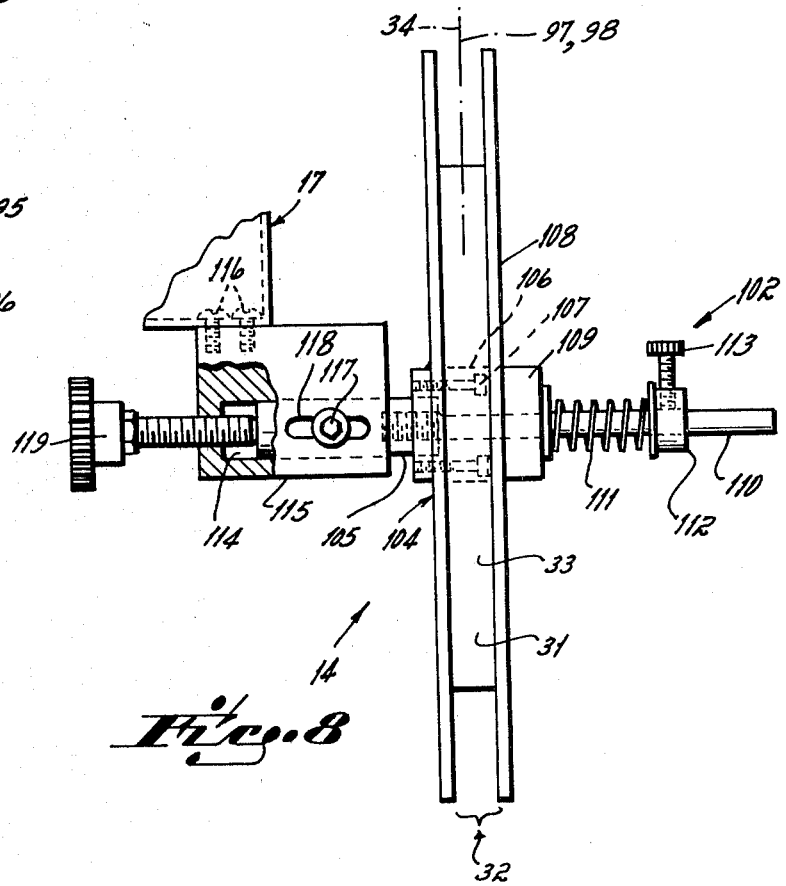
FIG. 8 is an end view of the spool adjustment structure illustrated in FIG. 1.

The spool adjustment structure 102 is particularly illustrated in FIGS. 1 and 8. The spool 33 includes a side plate 104 fixed on stationary axle 105, the stationary side plate 104 being fixed to that axle at primary hub 106 by bolts 107. A laterally movable and rotatable side plate 108 is fixed to secondary hub 109 and is received on axle end 110 against the primary hub 107. The rotatable side plate 108 is spring 111 loaded toward fixed side plate 104, compression being retained on the spring 111 by movable collar 112 adjustable along the axle 110 and retained in the adjusted position by thumb screw 113. The spring 111 loaded side plate 108 allows the spool 33 to accommodate different width tapes. The stationary axle 105 is received in bore 114 of mounting block 115. The mounting block 115 is fixed to the machine frame 17 by screws 116. The axle 105 is retained in fixed relation with the mounting block 115, and thereby the spool 33 is also retained relative to center plane 34, by thumb screw 117 (which is threaded into the axle 105) that is slideable in slot 118 in the mounting block. Adjustment wheel 119 is threadedly engaged also with the mounting block 115 to bear axially against the spool's axle 105, thereby providing a fine adjustment by which the spool 33 can be moved laterally relative to the axle tape feed mechanism 12 and printer head 11. In this way the center plane 97 of the tape reel 32 can be aligned parallel to the desired planar travel path 34 of the tape strip.

In use of the label machine of this invention, a new reel 32 of tape is initially installed on the spool 33 by removing sideplate 108. The sideplate 108 is then reinstalled on axle 110 with spring 111 being provided with suitable compression through use of collar 112 and set screw 113. Subsequently, the tape strip 31 is withdrawn from the reel 32 and threaded through the tape feed mechanism 12 and under the cutter anvil 27 onto the printing platen 20 as shown in FIG. 3. The center line 98 of the tape strip is then aligned in the vertical center plane 34 of the tape feed mechanism 12 and printer 11 as shown in FIG. 2. The center plane 97 of the reel 32 is then aligned likewise in the plane 34 by use of adjustment wheel 119. The position of brake shoe 24 relative to brake drum 25 is then adjusted by locator structure 38, 39, so as to define the length L′ of the free end 36 of the tape strip 31 which will be extended from the tape feed mechanism 12 upon operation of a single cycle of that mechanism. This tape strip length L′ is the same as the stroke length L′ between brake shoe 24 and drum 25. The label machine is now ready to cut and print labels **36*a* from the tape reel 32**.

The operating sequence commences with the rack's pneumatic motor 23 drawing the rack 22 along work stroke 35, thereby rotating drive wheel 21 to eject a tape section 36 at the free end of the tape strip 31 onto the printing anvil 20. The length of the label section 36 is established and controlled by the length L of the work stroke 35, and by stopping the drive wheel 21 immediately upon braking contact of the brake shoe 24 with the brake drum 25. Thereafter, pneumatic motor 18 for the print head 11 is activated for pivoting the print head 11 into printing relation with the label section 36 on the printing platen 20, while simultaneously the rack 22 is returned to its home position along return stroke 93 by the pneumatic motor 23. The label strip 31 is not moved during the return stroke 93 of the rack 22 because of the one-way clutch bearings 89, 90 as previously mentioned. While the print head 11 is holding the label strip section 36 down on the printing platen 20, the cutter assembly's pneumatic motor 28 raises the knife blade 26 to cut the label section 36 from the tape strip 31. Subsequently, the print head 11 is returned to its home position shown in FIG. 1 through use of pneumatic motor 18. The exhaust air from the lower chamber of the print head cylinder 18 is exhausted from that chamber through exhaust air line 30 into nozzle 15, and is discharged through bore 79 in that nozzle so as to blow the label section 36 across the print platen 20 and into the collection tray 16. When the exhaust air from the pneumatic motor 18 is completely exhausted, the cycle begins over once again. This operational or method cycle may be controlled by a pneumatic circuit through use of suitable control valves, not shown.

Having described in detail the preferred embodiment of my invention, what I desire to claim and protect by Letters Patent is:

1. A machine for forming tape sections of a predetermined length from an endless tape strip, said machine comprising a drive roll adapted to extend said endless tape strip in response to rotation thereof, a brake shoe reciprocable into and out of braking relation with said drive roll, the reciprocable stroke length of said brake shoe relative to said drive roll controlling the tape section length extended by said drive roll, said brake shoe being movable into braking relation with said drive roll when said drive roll has extended said endless tape strip a predetermined length for insuring generally accurate tape section length time after time, brake shoe locator structure for varying the reciprocable stroke length of said brake shoe relative to said drive roll, said locator structure permitting an increase or decrease in the length of said tape section as extended in response to an increase or decrease of said brake shoe stroke length relative to said drive roll, and a cutter assembly operable to cut said tape section of predetermined length from said endless tape strip.

2. A machine as set forth in claim 1, said machine further comprising a rack cooperable with a pinion for rotating said drive wheel, and said brake shoe being mounted on said rack, and a brake drum mounted on said drive roll's shaft, the work stroke of said rack simultaneously rotating said drive roll and causing said brake shoe to move into braking relation with said brake drum for establishing and controlling the predetermined length of said tape section.

3. A machine as set forth in claim 2, said machine further comprising a one-way clutch connected between said pinion and said drive roll, said one-way clutch permitting said rack to rotate said drive roll on the work stroke of said rack, but preventing said rack from rotating said drive roll on the return stroke of said rack.

4. A machne for forming tape sections of a predetermined length from an endless tape strip, said machine comprising a drive roll adapted to extend said endless tape strip in response to rotation thereof, a rack cooperable with a pinion for rotating said drive roll, and a brake shoe mounted on said rack, said brake shoe being reciprocable into and out of braking relation with said drive roll, the reciprocable stroke length of said brake shoe relative to said drive roll controlling the tape section length extended by said drive roll, the work stroke of said rack simultaneously rotating said drive roll and causing said brake shoe to move toward braking relation with said drive roll, and said brake shoe being in braking relation with said drive roll when said drive roll has extended said endless tape strip a predetermined length for insuring generally accurate tape section length time-after-time, and a cutter assembly operable to cut said tape section of predetermined length from said endless tape strip.

5. A machine as set forth in claim 4, said machine further comprising brake shoe locator structure for varying the reciprocable stroke length of said brake shoe relative to said drive roll, said locator structure permitting an increase or decrease in the length of said tape section as extended in response to an increase or decrease, respectively, of said brake shoe stroke length relative to said drive roll.

6. A machine as set forth in claim 4, said machine further comprising a brake drum mounted on said drive roll's shaft, said brake drum cooperating with said brake shoe when said predetermined length of said endless tape strip has been extended by said drive roll.

7. A machine as set forth in claim 6, said machine further comprising a one-way clutch connected between said pinion and said drive roll, said one-way clutch permitting said rack to rotate said drive roll on the work stroke of said rack, but preventing said rack from rotating said drive roll on the return stroke of said rack.

* * * * *

UNITED STATES PATENT AND TRADEMARK OFFICE

CERTIFICATE OF CORRECTION

PATENT NO. : 4,248,112

DATED : February 3, 1981

INVENTOR(S) : Bobby J. Clay

It is certified that error appears in the above—identified patent and that said Letters Patent is hereby corrected as shown below:

In column 1, line 47, change "," to --.--.

In column 2, line 21, change "entended" to --extended--.

In column 2, line 61, change "scetional" to --sectional--.

In column 3, line 65, change the second occurrence of "the" to --The--.

In column 4, line 11 change "bracked" to --bracket--.

In column 4, line 15, change "57" to --67--.

In column 6, line 5, change "rthe" to --the--.

In column 8, line 14, change "machne" to --machine--.

Signed and Sealed this

*Twenty-eighth* Day of *July 1981*

[SEAL]

*Attest:*

GERALD J. MOSSINGHOFF

*Attesting Officer*

*Commissioner of Patents and Trademarks*